United States Patent [19]

Duval et al.

[11] Patent Number: 4,720,333

[45] Date of Patent: Jan. 19, 1988

[54] ELECTROLYSIS TANK SUPERSTRUCTURE WITH INTERMEDIATE GANTRY, FOR THE PRODUCTION OF ALUMINIUM

[75] Inventors: Christian Duval; Bernard Langon; Michel Leroy; Alain Noizet, all of Saint-Jean-de-Maurienne, France

[73] Assignee: Aluminium Pechiney, Paris, France

[21] Appl. No.: 868,145

[22] Filed: May 29, 1986

[30] Foreign Application Priority Data

May 30, 1985 [FR] France ..... 85 08578

[51] Int. Cl.[4] ..... C25C 3/10; C25C 7/06; C25B 15/02

[52] U.S. Cl. ..... 204/241; 204/243 R; 204/244; 204/286; 204/273

[58] Field of Search ..... 204/243 R–247, 204/286, 241, 273

[56] References Cited

U.S. PATENT DOCUMENTS

| | | | |
|---|---|---|---|
| 2,958,635 | 11/1960 | DeNora | 204/243 R |
| 3,126,326 | 3/1964 | Frerotti et al. | 204/243 R X |
| 3,245,898 | 4/1966 | Wunderli | 204/243 R |
| 3,607,685 | 9/1971 | Johnson | 204/243 R X |
| 4,222,841 | 9/1980 | Miller | 204/274 X |
| 4,465,578 | 8/1984 | Duclaux et al. | 204/286 X |
| 4,608,134 | 8/1986 | Brown | 204/241 X |
| 4,608,135 | 8/1986 | Brown | 204/241 X |

*Primary Examiner*—Donald R. Valentine

*Attorney, Agent, or Firm*—Dennison, Meserole, Pollack & Scheiner

[57] ABSTRACT

The invention concerns a superstructure for a tank for the production of aluminum using the Hall-Heroult process by the electrolysis of alumina in molten cryolite, the tank being formed by a rigid metal heat-insulated casing of elongate parallelepipedic shape, the two ends of which are referred to as heads, and a superstructure formed by at least one rigid beam disposed along the long length of the casing, supporting in particular the anodic bus and the anodes and resting at its two ends on supports disposed at the two head ends of the tank, said superstructure being characterized in that each rigid beam is supported on at least one intermediate gantry in the central part thereof. The gantry may comprise four legs so as to constitute an inherently stable structure or it may be formed by two half-elements each provided with two legs. Preferably, each rigid beam is divided into two equal portions, the central ends of which are supported on the gantry.

25 Claims, 5 Drawing Figures

Figure 1:
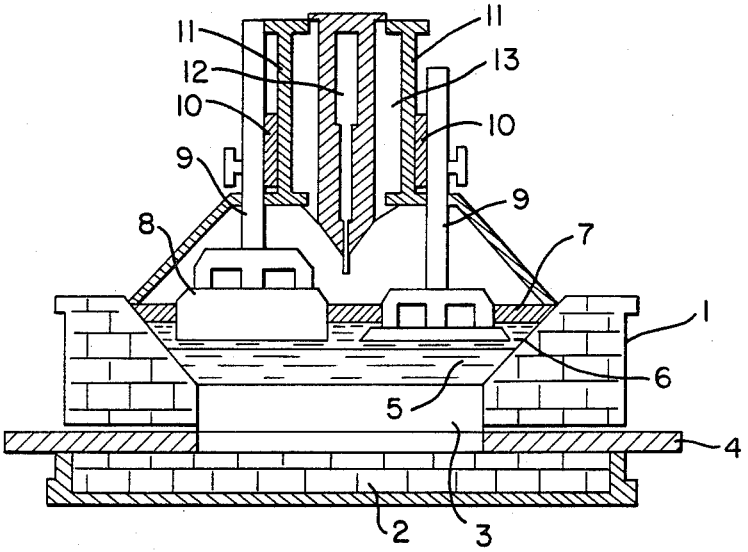

ELECTROLYSIS TANK SUPERSTRUCTURE WITH INTERMEDIATE GANTRY, FOR THE PRODUCTION OF ALUMINIUM

1. TECHNICAL AREA OF THE INVENTION

The present invention concerns an arrangement of the gantry type, which is intended to support at its centre or at one or more intermediate points the superstructure of a Hall-Héroult electrolysis tank for the production of aluminium.

2. PRESENT STATE OF THE ART

The superstructure of a modern electrolysis tank is formed by one or more horizontal beams made of steel which are supported on legs at heir ends and which support on the one hand the anodic current risers and the anodic frame structure formed by aluminium bars from which the anodes are supplied, and on the other hand the alumina feed systems (alumina reservoir, crust-breaking device, distributor-metering system), the systems for controlling upward and downward movements of the anodes and, in many cases, ducts for carrying effluents, gas and dusts emitted by the tank.

The legs bear at the ends of the metal casing which forms the electrolysis tank in the true sense. That arrangement has the advantage of making space available at the two long sides of the tanks, by way of which operations of changing anodes are effected, and also the advantage of not transmitting to the superstructure the transverse thermal expansion phenomena which occur in the general part of the casing after the tank has been brought into operation, on starting up.

3. PROBLEMS RAISED BY THE DEVELOPMENT IN THE ART

The present tendency is to provide for a constant increase in the unitary power of the tanks, which results in an increase in the length of the casing, which length may now be between 15 and 20 meters for tanks which operate at 250 KA and above.

In that case, the construction of the superstructure raises a difficult problem: the procedure involved in regulating the tanks does in fact require extremely accurate positioning of the anodic plane with respect to the cathodic plane formed by the layer of liquid aluminium which remains perfectly horizontal (except for minor local variations due to magnetic effects).

The anodes being supported by the superstructure, the latter must be of sufficient rigidity to:

support its own weight, support the force required to break the crusts formed by solidified electrolyte and which resist the vertical movements of the anodes and which are particularly hard in modern tanks using electrolytes with a high proportion of $AlF_3$, and ensure that the anode-cathode distance is constant over the entire length of the tank (that distance is of the order of 40 mm).

In order to impart a sufficient level of rigidity to the superstructure in accordance with the foregoing criteria, the mass (thickness of the beams) and the height thereof are increased. The increase in height has repercussions on the height of the building and therefore the cost thereof. That therefore quickly sets a limit on that line of development.

4. SUBJECT OF THE INVENTION

The aim of the invention is to solve the problem of rigidity of the superstructure in modern high-power tanks for the production of aluminium using the Hall-Héroult process, operating at current strengths which may go from more than 200,000 to 500,000 amperes and even higher, without thereby interferring with normal operation of the tanks, which in particular involves periodic changes of anodes when they are worn out.

The invention concerns a superstructure for a tank for the production of aluminium using the Hall-Héroult process by the electrolysis of alumina in molten cryolite, the tank being formed by a rigid metal casing which is internally lined with heat insulation and which is provided with a carbonaceous cathode, of elongate parallelepipedic shape, the two ends of which are referred to as the heads, and a superstructure formed by at least one beam disposed along the long length of the casing and supporting in particular the anodic frame structure which is supplied with current by positive input members and to which the anodes are fixed, said beam resting at the ends thereof on supports disposed at the two heads of the tank, said superstructure being characterised in that each beam rests on at least one intermediate gantry. In addition the support leg or legs of said gantry is or are preferably disposed in line with conductors carrying the current coming from the preceding tank, and the supports comprise means for expansion thereof independently of the casing. The beam may be formed in respect of its length by a single element or by a plurality of separate elements.

5. DESCRIPTION OF THE DRAWINGS

FIG. 1 recalls the structure in cross-section of a modern electrolysis tank of Pechiney type, FIGS. 2 to 5 relate to the invention; in order to be true to the proportions involved (width/length of the casing), a part of the length of the superstructures in these two Figures has been cut off. Moreover, also not shown are the arrangements for fixing the anodes, and the arrangements for height adjustment of the anodic assemblies, which are not part of the invention and which are well known to the man skilled in the art.

In FIG. 1, the essential components of the electrolysis tank are emphasised: the metal casing 1, the internal lining 2, the cathode 3 and the cathodic bar 4, the layer of liquid Al 5, the molten cryolite bath 6 covered with a solidified crust 7, the anodes 8 which are suspended by rods 9 and fixed to the anodic frame structure 10 and the superstructure formed by the two rigid beams 11 which support in particular the anodic frame structure 10, the assembly of the anodes 8 and the alumina distributor-metering system 12 whose local storage silo 13 is often disposed between the two beams 11, as well as the effluent carrying conduits which are not shown.

Figure 2:
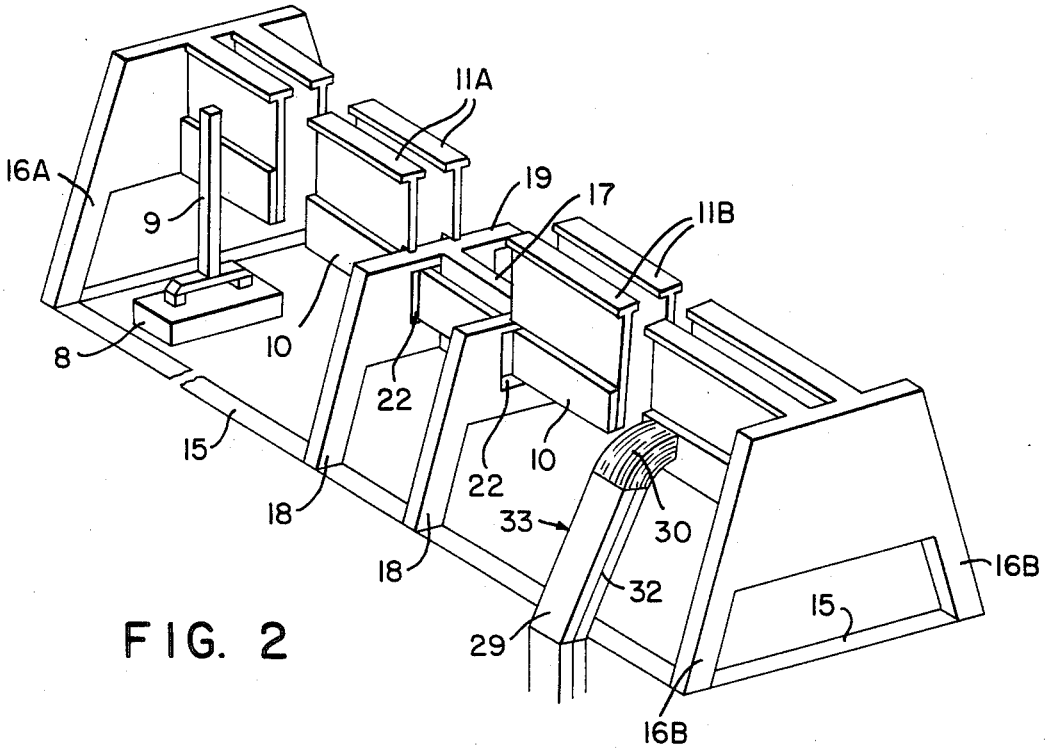

FIG. 2 which represents an embodiment of a superstructure according to the invention diagrammatically shows the outline of the upper rim 15 of the casing 1. The rigid beams 11 which form the superstructure are divided into two parts 11A and 11B, the outside ends of which are supported on the legs 16A and 16B disposed at each head end of the tank while the central ends are supported on the gantry 17.

However it would not be contrary to the invention for the rigid beams 11 to be made in a single length; apart from questions of transportation and positioning thereof, the problem of their linear expansion would then have to be taken into consideration in the design of the superstructure.

In FIG. 2, the above-mentioned gantry itself comprises four legs 18 which rest on the upper rim 15 of the casing in the central part thereof. The support system must take account of the fact that the casing expands in the course of operation, in particular in the transverse direction, and it therefore does not truly constitute a fixed point of support. It is therefore necessary to provide a freedom of movement in respect of such support in the direction of expansion of the casing, that is to say in the general direction of the current which passes through the line of tanks which are disposed crosswise with respect to the axis of the line, for example by means of roller bearing assemblies which are suitably protected from the abrasive dust produced from the alumina and other constituents of the electrolyte. In order to enhance such protection, it is fully in accordance with the general principles underlying the invention to provide sliding or rolling supports which permit a freedom of relative movement of the support with respect to the casing at the level of the rim edges 15 or several centimeters or decimeters above the level of the rim edge 15. Account must also be taken of the amount of space occupied by positive input members as indicated at 29 at the side of the tank (current inputs from the preceding tank in the series, connected to the anodic frame structure of the tank; only one of the input members is illustrated). Finally, in order to take account of the operation of changing anodes which is also carried out at the side (only one of the anodes is diagrammatically shown in the drawing but there are at least about twenty on each side in high-power tanks), the arrangment selected will preferably be such that the support leg or legs of the superstructure is or are positioned at the same positional gauge as the current input members coming from the upstream tank.

When the superstructure is divided into two independent parts 11A and 11B which are disposed on respective sides of the intermediate gantry, there are no longer any flexural stresses at the location of the gantry; in addition, production, transportation and positioning of the two elements are simplified by virtue of the reduction in length and weight.

The ends of the beams 11A and 11B are preferably supported on the intermediate gantry 17 by a means permitting the slight relative movements of the supports for the beams on the gantry to be absorbed. A simple solution in that respect consists of allowing the central ends of the beams 11A and 11B to rest freely on the upper part 19 of the gantry 17.

The anodic frame structure 10 is preferably also formed in two parts so as to distribute the expansion phenomena on respective sides of the centre of the superstructure. An expansion joint which ensures electrical contact, for example a loop of aluminium straps or any other equivalent means, is then disposed between the two parts of the bus.

The construction of the central gantry 17 with four legs affords the advantage of making it an element which is stable in itself and which can thus serve as a support and connecting member for a superstructure made up of two independent portions, and may even serve as a support for assemblies for motorisation of the upward and downward movements of the anodes; the central position is advantageous in regard to distribution of the forces to the two halfframes which are supported by the two half-beams.

As stated hereinbefore, the legs 18 of the gantry may be supported on the upper edge 15 of the casing but also at the outside, on specialised elements, for example a support body or pillars of reinforced concrete. That arrangement which makes it possible to obviate the problems of transverse expansion of the casing does however make it necessary to increase the space provided between the tanks and therefore to increase the length or the width of the building, which has repercussions on the prime cost.

Another embodiment of the invention (FIG. 3) involves supporting each half-portion of the beams 11A and 11B by means of two independent gantries 20 having two legs, one for the ends 24A of 11A and one for the ends 24B of 11B. In that case, and in order to ensure stability, each gantry 20A and 20B must be welded respectively to the beams 11A and 11B at the location of the supports 21A and 21B.

In the various constructions, it is possible to provide for the anodic frame structure or structures 10 to pass through openings 22 provided in the upper horizontal part of the intermediate gantry. However such openings are not necessary if the gantry 18 is positioned below or above the anodic frame structure 10.

Figure 3:
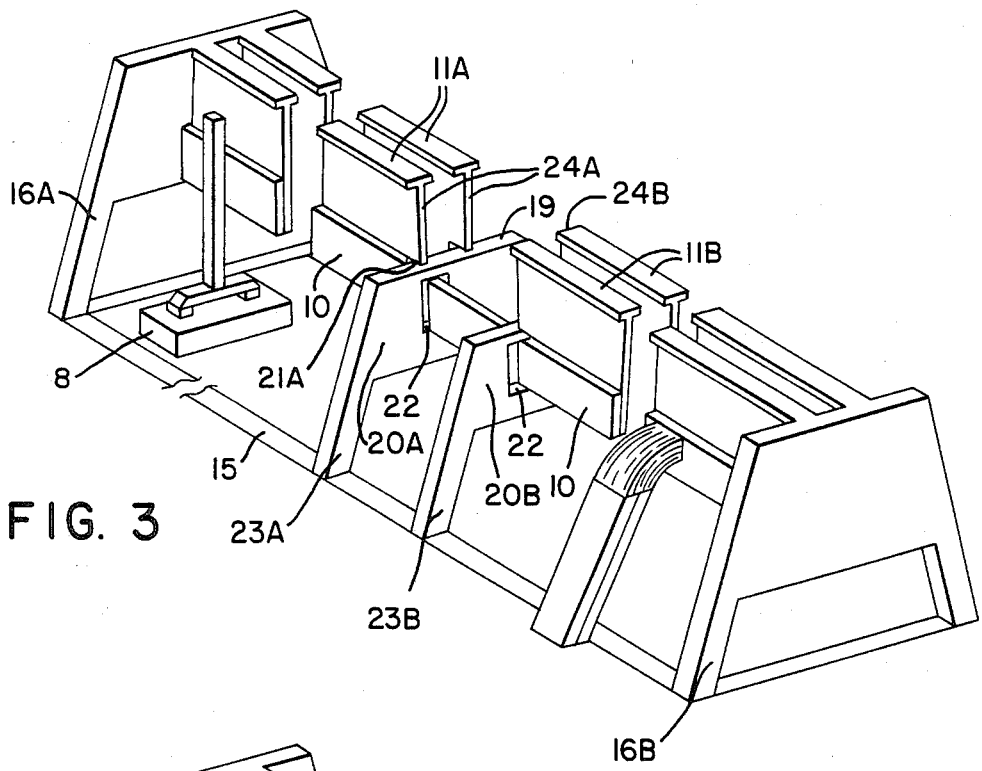
Figure 4:
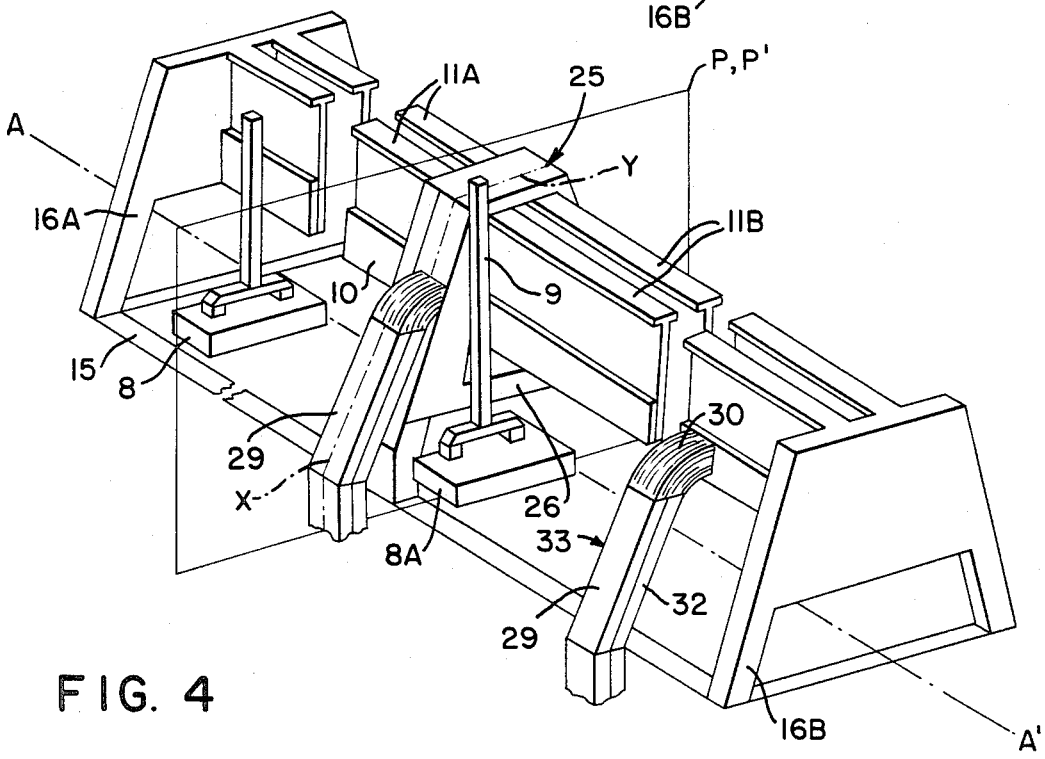

Reference will now be made to FIG. 4 showing another alternative embodiment of the invention, in which the intermediate gantry is of a shape which resembles that of an A as indicated at 25, the beam 11 being supported on the horizontal cross bar 26 of the A-shape. A particularly advantageous construction involves using as the gantry two A-shaped elements which are braced together so as to form a rigid gantry, the two elements being spaced at a distance such that a current input member 29 can be disposed between them, the current input member 29 being connected to the frame structure 10. In some cases, it may be necessary to move away slightly the anodes such as 8A which are disposed on respective sides of A-shaped gantry 25, so as to facilitate the operations of replacing worn anodes. Positioning of the gantry at the location of one at least of the current input members 29 coming from the preceding tank is otherwise entirely compatible with the structures of gantries having two and four legs as shown in FIGS. 2 and 3.

Figure 5:
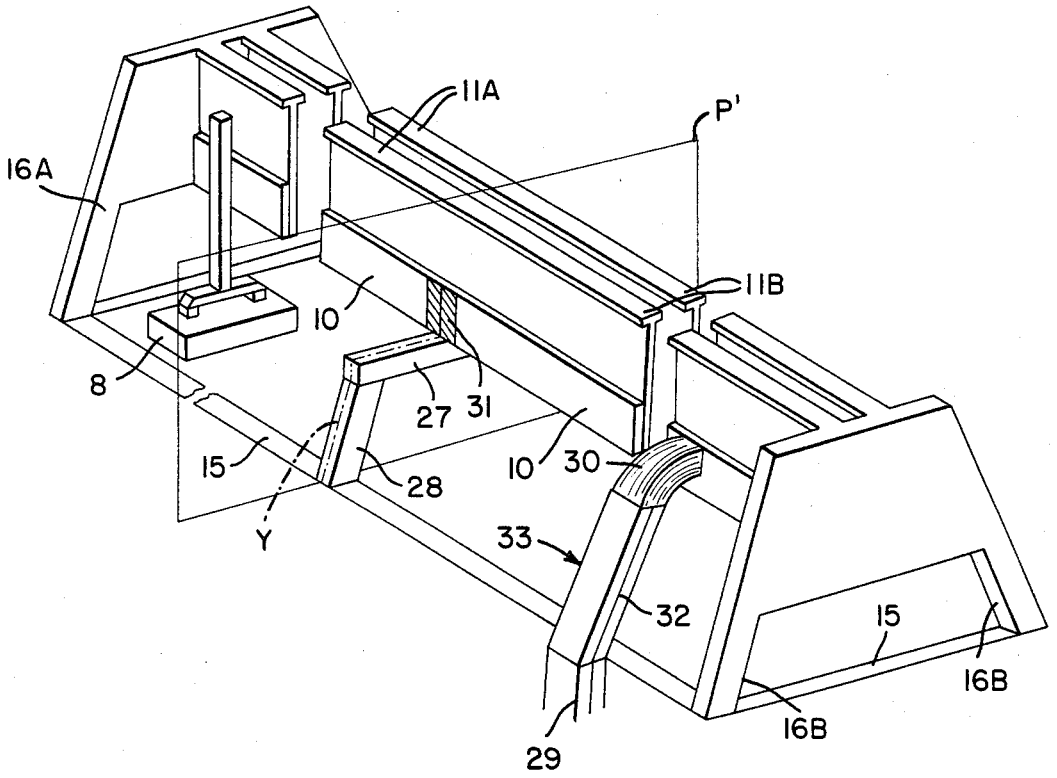

Finally, FIG. 5 shows another embodiment of the invention which is particularly simplified since it is reduced to a horizontal support beam 27 resting on two legs 28 (the second leg is not visible in FIG. 5). The horizontal support beam 27 is shown as being of square tubular shape but it may also be formed by any member of conventional configuration, for example of I-shape, the dimensions of which are based on the well-known calculations relating to the strength of materials.

In such an embodiment, it is also preferable to provide one of the current input members 29 in line with the intermediate support 27 and 28, that is to say substantially in the same vertical plane as the support, the flexible foils 30 which provide the electrical connection between the input member 29 and the anodic frame structure 10 being connected to the frame structure 10 in the hatched area 31 so as to liberate the maximum amount of space for the operations involved in changing worn anodes as indicated at 8 and 8A.

More precisely, that arrangement can be characterised by taking the view that the vertical transverse plane P (which is perpendicular to the major axis AA' of the tank), passing through the axis X of the current input member, and the vertical plane P' passing through the axis Y of the corresponding intermediate gantry, must be substantially merged with each other or at least disposed at a small distance from each other and substantially parallel to each other so that the assembly of the leg and the positive current input member occupy a minimum amount of space.

Although the invention has been described in relation to the particular situation where the rigid beams 11 are divided into two parts and are supported on a central gantry, it will be apparent to the man skilled in the art that the invention also applies to the situation where, for a tank of larger size, the rigid beams 11 are divided into more than two parts, for example three parts, which may or may not be equal, being supported on two intermediate gantries having two or four legs. Such tank superstructures may therefore be formed in a modular fashion so that their maximum length is no longer limited by the weight of the beams and the difficulties involved in transportation and positioning thereof, which were additional to the problems of flexing of the beams.

Finally, the invention makes it possible to take account of the effects of sag or bowing of the beam, which are due to differential thermal expansion phenomena. In fact, the horizontal support beam such as 26 or 27 of the gantry is subjected to variations in temperature which depend on the covering of alumina of the crust. The highest temperature will be reached when changing an anode in the vicinity of that beam, that change causing a break in the solidified electrolyte crust so that the electrolyte, at about 930° to 960°, radiates directly on to the superstructure.

The thermal gradient between the upper part and the lower part of the beam causes bowing thereof. If that bowing effect is incompatible with regulation of the tank, it is necessary to reduce the thermal gradient. Achieving good control of expansion makes it possible to simplify the points of support of the gantry on the casing if the expansion phenomena are similar.

For that purpose, use is made of one or more of the following solutions, which act on the various factors causing bowing of the beam:

(a) Material: for the beam it is possible to use nickel steels which have a degree of expansion half that of ordinary steel, (b) removal of heat by the circulation of air: heat can be removed by circulating air within and/or around the beam, (c) removal of heat by Caloduc: closed tubes containing a fluid at the limit of the vaporisation temperature are disposed in contact with the lower part of the beam at one end and at the outside of the tank at the other end. The heat of the exposed part of the beam vaporises the liquid, that gas rises in the tube and condenses in the outer part, giving off the heat, (d) balancing of temperatures: a thermal bridge may be installed between the lower part of the beam and the upper part thereof. It is to be made of a material which is a good conductor heat such as aluminum, (e) thermal screen: a reflecting and/or thermal-insulation screen which is installed under the beam protects it from the heat radiation which is caused when changing an anode.

The invention, in the various embodiments described above, overcomes one of the most serious obstacles to the construction of tanks with a capacity of 500,000 amperes (and even higher), which provide highly attractive technical and economic advantages.

We claim:

1. In a superstructure for a tank for the production of aluminium using the Hall-Héroult process by the electrolysis of alumina in molten cryolite, the tank being formed by a rigid metal heat-insulated casing of elongate parallelepipedic shape, the two ends of the tank comprising heads, and a superstructure formed by at least one rigid beam disposed along the long length of the casing at least supporting an anodic frame structure and the current input members coming from a preceding tank in a series of tanks and the anodes of the tank, and the beam at least resting at its two ends on supports disposed at the two head ends of the tank, the improvement comprising said superstructure having said at least one rigid beam (11) supported on at least one intermediate gantry provided with a horizontal support surface on which said at least one beam rests, and legs, said horizontal support surface being located entirely below said at least one rigid beam without said at least one intermediate gantry passing through said at least one rigid beam.

2. A tank superstructure according to claim 1 wherein the gantry (17) comprises four legs (18) so as to provide a structure which is stable in itself.

3. A tank superstructure according to claim 1 wherein the gantry (17) is formed by two half-elements (20A, 20B) each provided with two legs as at (23A and 23B).

4. A superstructure according to claim 1 wherein the gantry is formed by a single horizontal support beam (27) which is supported on two legs (28).

5. A superstructure according to claim 1, wherein said at least one gantry additionally comprises elements located laterally of said at least one rigid beam and extending from said support surface in a generally upward direction.

6. A superstructure according to claim 5, wherein said lateral elements are connected by a cross-piece located above said at least one rigid beam.

7. In a superstructure for a tank for the production of aluminium using the Hall-Héroult process by the electrolysis of alumina in molten cryolite, the tank being formed by a rigid metal heat-insulated casing of elongate parallelepipedic shape, the two ends of the tank comprising heads, and a superstructure formed by at least one rigid beam disposed along the long lengths of the casing at least supporting an anodic frame structure and the current input members coming from a preceding tank in a series of tanks and the anodes of the tank, and the beam at least resting at its two ends on supports disposed at the two head ends of the tank, the improvement comprising said superstructure having said at least one rigid beam (11) supported on at least one intermediate gantry provided with legs, said at least one intermediate gantry formed by two half elements (20A, 20B), each provided with two legs.

8. A superstructure according to claim 1 or 7 wherein said at least one rigid beam (11) is divided into at least two portions (11A, 11B), the central ends (24A, 24B) of which are supported on the gantry.

9. A superstructure in which according to claim 8 in which the legs (18) or (23A, 23B) or (28) which support the outer ends of the rigid beams (11A, 11B) are supported on the rims (15) of the casing.

10. A superstructure according to claim 5 in which the legs (18) or (23A, 23B) or (28) which support the ends of the rigid beams (11A, 11B) are supported at the outside of the rims (15) of the casing.

11. A superstructure according to claim 7, wherein one said current input member passes between said two half elements.

12. A superstructure according to claim 11, wherein said two half elements each comprises a horizontal support surface, a pair of elements lateral to said at least one rigid beam and extending from said horizontal support surface generally upward, and a cross-piece located above said at least one rigid beam which connects said lateral elements.

13. A superstructure according to claim 7 or 3, wherein said at least one rigid beam is fixed to the gantry element on which it is supported.

14. In a superstructure for a tank for the production of aluminium using the Hall-Héroult process by the electrolysis of alumina in molten cryolite, the tank being formed by a rigid metal heat-insulated casing or elongate parallelepipedic shape, the two ends of the tank comprising heads, and a superstructure formed by at least one rigid beam disposed along the long length of the casing at least supporting an anodic frame structure and the current input members coming from a preceding tank in a series of tanks and the anodes of the tank, and the beam at least resting at its two ends on supports disposed at the two head ends of the tank, the improvement comprising said superstructure having said at least one rigid beam (11) supported on at least one intermediate gantry provided with legs, said at least one rigid beam (11) being divided into at least two portions (11A, 11B), the central ends of which are supported on the gantry.

15. A superstructure according to claim 1, 7 or 14 in which the legs (18) or (23A, 23B) of the gantry (17) are supported freely on the rim (15) of the casing.

16. A superstructure according to claim 1, 7 or 14 in which the legs (18) or (23A, 23B) or (28) of the gantry (17) are supported on the rim (15) of the casing by a means permitting relative displacement.

17. A superstructure according to claim 1, 7 or 14 in which the legs (18) or (23A, 23B) or (28) of the gantry (17) are supported on the rim (15) of the casing by a means permitting relative displacement, the legs at the upstream or downstream side being pivotally mounted on the casing edge by means of an axis which is parallel to the major axis of the tank and the opposite legs on the downstream or upstream side being supported on the casing.

18. A superstructure according to claim 1, 7 or 14 which further includes the gantry being provided with a horizontal support beam (26) or (27) including means for affording protection from thermal radiation from the electrolysis bath.

19. A superstructure according to claim 18 wherein the means for affording protection from radiation from the bath is formed by a thermal screen disposed beneath the horizontal support beam.

20. A superstructure according to claim 18 wherein the means for affording protection from radiation from the bath is formed by a means for rapid removal of the heat absorbed by the horizontal support beam.

21. A superstructure according to claim 20 wherein the means for rapid removal of heat comprises circulation of a heat exchange fluid in heat exchange relationship with the horizontal support beam.

22. A superstructure according to claim 20 wherein the means for rapid removal of heat comprises thermal bridges of good thermal conductivity.

23. A superstructure according to claim 20 wherein the means for rapid removal of heat comprises closed tubes containing an evaporative cooling medium.

24. A superstructure according to claim 1, 7 or 14, wherein the location of one said current input member is defined by a transverse axis X, and the location of said at least one intermediate gantry is defined by a transverse axis Y, and wherein a vertical transverse plane P which passes through said axis X is substantially coincident with a vertical transverse plane P′ which passes through said axis Y.

25. In a superstructure for a tank for the production of aluminium using the Hall-Héroult process by the electrolysis of alumina in molten cryolite, the tank being formed by a rigid metal heat-insulated casing of elongate parallelepipedic shape, the two ends of the tank comprising heads, and a superstructure formed by at least one rigid beam disposed along the long length of the casing at least supporting an anodic frame structure and the current input members coming from a preceding tank in a series of tanks and the anodes of the tank, and the beam at least resting at its two ends on supports disposed at the two head ends of the tank, the improvement comprising said superstructure having said at least one rigid beam (11) supported on at least one intermediate gantry provided with legs, wherein the location of one said current input member is defined by a transverse axis X, and the location of said at least one intermediate gantry is defined by a transverse axis Y and wherein a vertical transverse plane P which passes through said axis X is substantially coincident with a vertical transverse plane P′ which passes through said axis Y.

* * * * *